United States Patent [19]

Bernert et al.

[11] 3,991,593

[45] Nov. 16, 1976

[54] WARP KNITTING MACHINE

[75] Inventors: Georg Bernert, Kirschau; Josef Kumpfel, Schland, Spree; Manfred Schneider, Karl-Marx-Stadt; Wolfgang Vogel, Jahnsdorf, all of Germany

[73] Assignee: VEB Wirkmaschinenbau Karl-Marx-Stadt, Karl-Marx-Stadt, Germany

[22] Filed: July 11, 1975

[21] Appl. No.: 594,996

[52] U.S. Cl. ..... 66/85 A

[51] Int. Cl.[2] ..... D04B 23/06

[58] Field of Search ..... 66/85, 85 A, 90, 109

[56] References Cited

UNITED STATES PATENTS 3,760,607 9/1973 Wildeman ..... 66/85 A

FOREIGN PATENTS OR APPLICATIONS 56,045 7/1969 Germany

*Primary Examiner*—Ronald Feldbaum

*Attorney, Agent, or Firm*—Nolte and Nolte

[57] ABSTRACT

In a warp knitting machine comprising a row of reciprocable needles having hooks, knock-over means and counter means spaced from the knock-over means so arranged that the reciprocation of the needles traverses the respective knock-over means and counter means, means for feeding a non-woven fabric between the knock-over means and the counter means, and means for opening and closing the hooks of the needles, the improvement comprising means defining a recess in the path of each of the needles, the recess being in the form of a space into which the fabric bulges as the needles are withdrawn from the fabric.

7 Claims, 5 Drawing Figures

WARP KNITTING MACHINE

BACKGROUND OF THE INVENTION

The present invention relates to a warp knitting machine and, more particularly, to a warp knitting machine of the Malimo type for the strengthening of a non-woven fabric.

This type of machine includes a row of knitting needles, the hooks of which can be closed by controllable slide wires, a row of knock-over sinkers, the sinkers being arranged between the needles, counter means for holding the non-woven fabric while it is being fed and stitched, the counter means being disposed opposite the knock-over sinkers and a supporting bar extending opposite the fabric surface which has been stitched in order to guide the non-woven fabric which has been stabilized by the stitching.

Apparatuses of the type involved in the present invention have been used to stabilize a non-woven fabric by stitching into the non-woven fabric a group of warp threads. The hooks of the needles engage not only the warp threads but also some of the fibers of the non-woven fabric and interwine those fibers with the warp threads. The result of this technique is that it is not possible to separate the warp threads from the stabilized non-woven fabric. Moreover, the warp threads are not capable of initiating runs. This run-stopping effect may be increased or diminished as required.

In a well-known apparatus of this type, the counter means, in the form of counter pins, are bent in stages in the direction of withdrawal of the fabric toward the knockover sinker in order to form a zone in which the fabric is compressed against the knock-over sinkers. The bent pins are subjected to a very high load and, conseequently, break quite often. This results in great losses of productivity and a large need for spare parts.

SUMMARY OF THE INVENTION

It is an object of the present invention to provide an apparatus of the aforementioned type in which difficulties arising from the breaking of counter pins are avoided.

It is a further object of the present invention to present the non-woven fabric to the needles in such a way that the hooks are capable of catching several fibers in order to intertwine them with the thread loops.

Other objects and advantages of the invention will be apparent to one skilled in the art from the following description.

According to the present invention, there is provided adjacent the face of the fabric at which the knitting takes place a recess open in the direction of the counter pins and which recess is traversed by the needles so that the needles by frictional engagement cause the fabric to bulge into the recess during the knitting operation. The bounds of the recess may be defined, for example, by the unrecessed surfaces against which the face of the fabric on which the knitting is taking place bears or by a rail extending immediately adjacent the needles at the side of the needles facing away from the hooks, the rail being parallel to the knock-over bar and being fastened thereon.

A second rail may be provided for defining the bounds of the recess, the second rail being adjustable in its distance from the plane of reciprocation of the needles so that the size of the recess can be adjusted in accordance with the thickness of the non-woven fabric and/or to regulate the amount of fibers engaged by the hooks of the needles and thereby formed into loops with threads. The same additional rail may be made adjustable toward or away from the knock-over means or obliquely.

In another embodiment of the invention, the recess is formed in the knock-over sinker, each knock-over sinker being provided with a projection, the crown of which limits the recess and the interstitial spaces between the sinkers in the vicinity of the crowns are filled with a material, such as a plastic or lead, in which knock-over sinkers are conventionally mounted.

It is found that the present invention eliminates the aforementioned prior art tendency of the counter pins to break.

BRIEF DESCRIPTION OF THE DRAWINGS

The invention will now be further described by reference to specific illustrative embodiments thereof, as shown in the drawings, in which.

DESCRIPTION OF THE PREFERRED EMBODIMENTS

Figure 1:
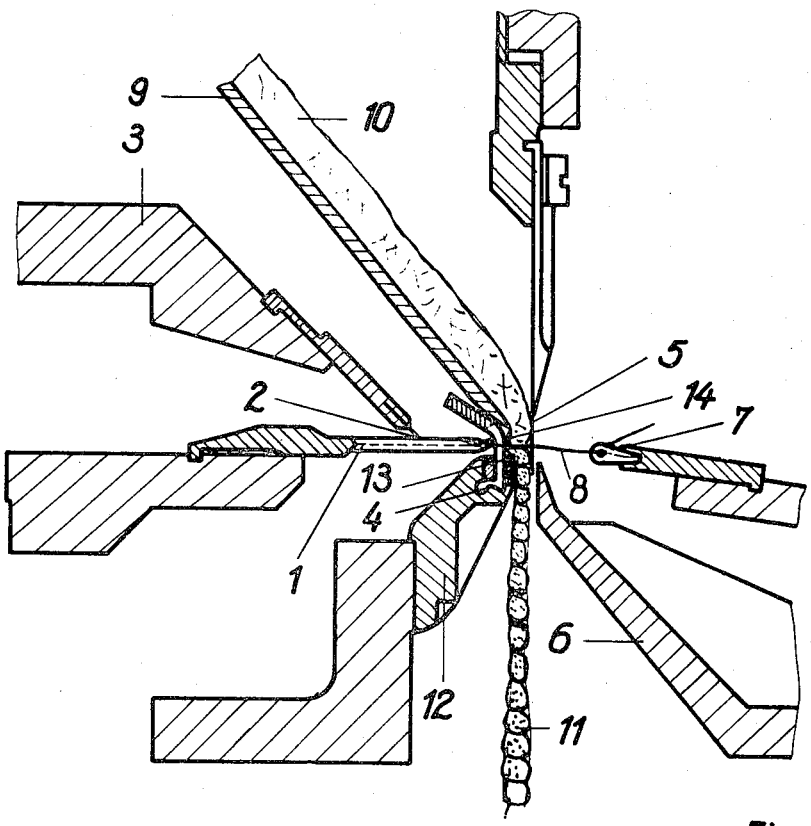
FIG. 1 is a longitudinal cross section of the knitting zone of a warp knitting machine according to the invention.

The machine in FIG. 1 is provided with a row of horizontally reciprocable knitting needles 1. The hooks 1*a* of the needles 1 can be closed by closure wires 2, the closure wires 2 being supported by a bar 3. The needles 1 traverse a row of stationary knock-over sinkers 4 and a row of stationary but adjustable counter pins 5. The counter pins 5 are prevented from deflecting significantly in the direction of advance of the needles 1 by a supporting bar 6 which is located immediately adjacent the pins 5 below the plane of reciprocation of the needles 1. A guide rail 7 provided with eyelet guides for guiding the respective knitting threads 8 to the hooks of the needles 1 is located in the plane of reciprocation of the needles 1 on the other side of the pins 5. A non-woven fabric 10 is fed over a sheet metal guide 9 to the knitting zone between the knock-over sinkers 4 and the pins 5. The non-woven fabric is stabilized by the knitting which takes place in that zone and the finished fabric 11 is pulled downwardly by means of a fabric transporting means (not illustrated). The knock-over sinkers are, as is well known, molded into mountings 12. A rail 13, provided with drill holes or recesses, is fastened onto the mounting 12 immediately beneath the needles 1. The rail is located on the knock-over edge of the sinkers 4.

The sheet metal guide 9 extends up to the knock-over edge of the knock-over sinkers 4 and may be adjusted in the direction of the needles 1 and/or in the direction of the pins 5. Usually, the distance from the front edge of the sheet metal guide 9 to the knock-over edge of the knock-over sinker 4 corresponds to the thickness of the rail 13 and is generally, depending upon the thickness of the non-woven fabric, in the range of 1.5 to 2 mm.

The apparatus illustrated in FIG. 1 operates as follows

Beginning at the position illustrated in FIG. 1, the needles 1 traverse the row of sinkers 4, penetrate the non-woven fabric 10 and traverse the row of pins 5.

The closure wires 2 follow the movement of the needles 1 so that the hooks of the needles 1 are open when the needles are in their forwardmost position. In that position, the knitting threads 8 are guided into the open hooks by the combination of the guide rail 7 and the eyelet guides mounted thereon. Now, the needles begin their motion in the opposite direction. Frictional engagement of the shafts of the needles with the non-woven fabric 10 feeds the non-woven fabric 10 to the front edge of the sheet metal guide 9 and the rail 13 and causes a bulging of the non-woven fabric 10 in the recess 14 defined between the respective edges of the sheet metal guide 9 and the rail 13, which, as can be appreciated in viewing FIG. 2, is a continuous recess along the machine in the direction of the row of needles in the path of the needles.

This action of the needles dragging the non-woven fabric 10 into the recesses 14 causes the parts of the non-woven fabric which are close to the pins 5 to be pressed against the needles 1 and fibers constituting those parts of the fabric to be stretched across the path of the open hooks of the needles 1 whereupon those fibers are engaged by the open hooks of the needles 1. The hooks are then closed by the closure wires and the needles are withdrawn from the fabric so that previously formed loops of the knitting threads entwined with fibers of the non-woven fabric are knocked over the hooks and the tips of the needles by the sinkers 4.

Figure 2:
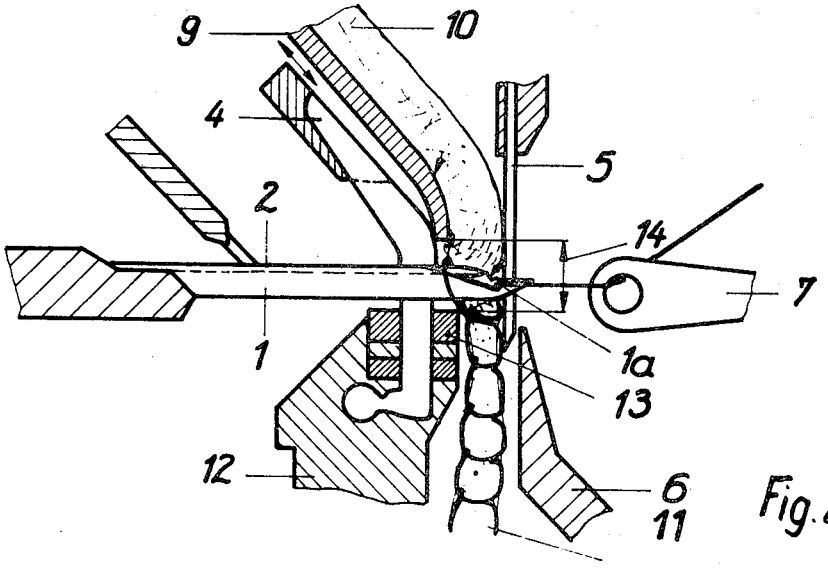
FIG. 2 is an enlargement of a portion of FIG. 1 in a moved position.

The stage at which the knitting threads have been guided into the hooks of the needles and the needles are being withdrawn into the non-woven fabric is illustated in FIG. 2. The previously formed loop can be seen resting on the needle behind the hook.

The knitting thread 8 and fibers of the non-woven fabric together gripped by the closed hook are pulled through the previously formed loop. They form a loop lying on the shaft of the needle behind the hook when the needle again is pushed into the fabric because the closure wires are so completely withdrawn prior to the forward movement of the needles that the closure wires are completely enclosed by the space in the needle shafts provided therefor and, consequently, the thread and fibers slide up the rearward slope of and out of the hook as the needle moves forward.

Figure 5:
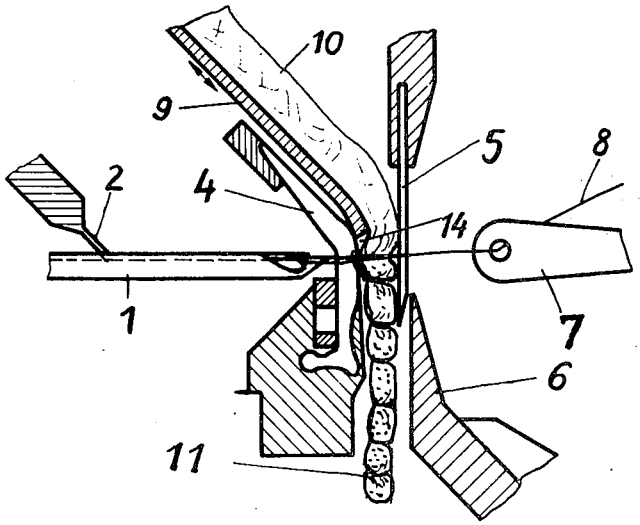

When very thick non-woven fabrics are being processed, it is necessary to shift the counter pins 5 and the bar 6 away from the sinkers 4 and to enlarge the recess 14 by shifting the sheet metal guide 9 upwardly and/or rearwardly. Of course, it is also possible to make the rail 13 adjustable in its vertical position and/or to exchange the sheet metal guide 9 for another of different dimensions (FIG. 5). Such alternatives may, however, be practical only when the machine is to produce the same fabric for a protracted period of time.

Figure 3:
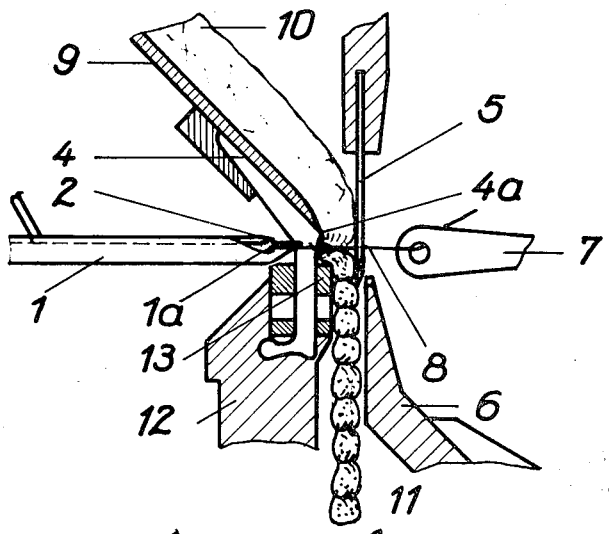
FIGS. 3, 4 and 5 correspond generally to FIG. 1 but show other embodiments

In FIG. 3, the apparatus of which operates in principle exactly like the apparatus of FIGS. 1 and 2, the function of the sheet metal guide 9 as a boundary for the recess 14 has been taken over by the projection 4*a* on the knock-over sinkers.

Figure 4:
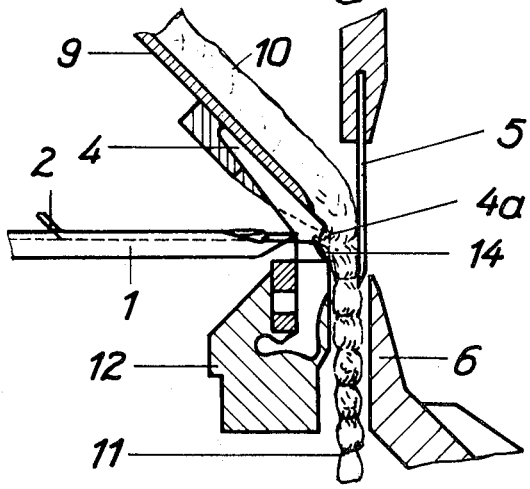

In FIG. 4, another analogous apparatus, the recess 14 is provided completely by the sinkers. It is particularly convenient in this instance that the lead or plastic material in the mountings 12 in which material the sinkers 4 are conventionally mounted extend between the sinkers 4 all the way to the crown of the projections 4*a*.

Particularly when processing non-woven fabrics which are heavy, it is advantageous to define the recess with flat knock-over sinkers 4 together with the rail 13 and the guide plate 9, as illustrated for example in FIGS. 1, 2 and 5, because the variations of FIGS. 3 and 4 impose higher lateral loads on the needles.

Apart from the aforementioned advantages, the present invention provides the further advantage that the holes which the needles create in the fabric tend to close more completely when the needles are withdrawn than in the prior art. This results in improved uniformity in the appearance of the fabric. Yet another advantage is attained when the fabric is to be subsequently napped or roughened. Heretofore, napping frequently caused breaks in the warp threads. Consequently, in many instances, the entire fabric disintegrated and napping was, practically speaking, impossible. The combined thread and fiber loops in the present invention in which a plurality of fibers are formed into a loop with each of the threads, assures the integrity of the fabric even after one or more of the warp threads are broken and, consequently, napping can successfully be carried out.

What is claimed is

1. In a warp knitting machine comprising a row of reciprocable needles having hooks, knock-over means and counter means spaced from the knock-over means so arranged that the reciprocation of the needles traverses the respective knock-over means and counter means, means for feeding a non-woven fabric between the knock-over means and the counter means, and means for opening and closing the hooks of the needles, the improvement comprising means having boundaries defining a recess extending continuously in the direction of the row of needles in the path of each of the needles and constituting means for receiving bulged fabric therebetween as the needles are withdrawn from the fabric.

2. In the warp knitting machine according to claim 1, the improvement further comprising a rail mounted parallel to the knock-over means adjacent the side of the needles facing away from the hooks of the needles, the knock-over means having knock-over edges and the rail having an edge located in the space between the knock-over means and the counter means so that said edge of the rail together with said edges of the knock-over means define the boundaries of said recess.

3. In the warp knitting machine according to claim 2, the improvement further comprising means defining another edge bounding the recess, said other edge being spaced from and parallel to said edge of said rail.

4. In the warp knitting machine according to claim 3, in the improvement in which the means defining the other edge is a guide for directing the non-woven fabric to the knitting zone.

5. In the warp knitting machine according to claim 3, in the improvement in which the means defining the other edge is adjustable so that the spacing between said other edge and at least one of the edge of the rail and the counter means may be varied.

6. In the warp knitting machine according to claim 1, in the improvement in which the boundaries are formed in the knock-over means.

7. In the warp knitting machine according to claim 6, in the improvement in which the knock-over means comprises a plurality of sinkers, on each of the sinkers is formed a projection defining one of the boundaries of the recess in the sinker and in the interstices between the sinkers in the vicinity of the projections is contained a mass of material selected from the group consisting of lead and plastics.

* * * * *